United States Patent [19]

Best et al.

[11] 4,052,868

[45] Oct. 11, 1977

[54] DOOR KNOB CONSTRUCTION

[75] Inventors: Walter E. Best; R. Gene McCullum, both of Indianapolis, Ind.

[73] Assignee: Best Lock Corporation, Indianapolis, Ind.

[21] Appl. No.: 677,727

[22] Filed: Apr. 16, 1976

Related U.S. Application Data

[63] Continuation-in-part of Ser. No. 523,570, Nov. 14, 1974, Pat. No. 3,955,387.

[51] Int. Cl.[2] ..... E05B 63/10; E05B 3/04

[52] U.S. Cl. ..... 70/224; 70/370; 70/451; 70/461; 292/347; 292/352

[58] Field of Search ..... 70/224, 370, 451, 461, 70/462, 146, 147, 148, 377, 449, 452, DIG. 62; 292/337, 347, 352, 357, 336.3, DIG. 63

[56] References Cited

U.S. PATENT DOCUMENTS

| | | | |
|---|---|---|---|
| 1,938,112 | 12/1933 | Schlage | 70/452 |
| 2,301,751 | 11/1942 | Schlage | 70/224 |
| 2,719,424 | 10/1955 | Rayburn | 70/224 |
| 2,848,264 | 8/1958 | Lynch | 292/347 |
| 2,976,073 | 3/1961 | Russell et al. | 292/347 X |
| 2,998,274 | 8/1961 | Russell | 292/169 |
| 3,077,100 | 2/1963 | Gerlach | 70/224 |
| 3,096,115 | 7/1963 | Patriquin et al. | 292/347 |
| 3,190,091 | 6/1965 | Russell et al. | 70/224 |
| 3,413,829 | 12/1968 | Russell | 70/224 |

*Primary Examiner*—J. Franklin Foss
*Attorney, Agent, or Firm*—Jenkins, Hanley & Coffey

[57] ABSTRACT

A door knob is machined from solid stock to provide a tubular neck, an intermediate portion which is internally recessed to reduce its wall thickness, and a solid-section end portion having a large axial end opening which provides tool access for recessing the mid-portion and clears the pin tumbler lobe of a key-removable core mounted in the knob sleeve with its key plug concentric with the knob. The end opening has an axially-outward facing shoulder and an adjacent radially-inward opening groove. A knob locating, bevelled-edge ring lies against the shoulder with its edge partially closing the mouth of the groove. An end face member having a peripheral bevelled skirt is pressed into the end opening and against the edge of the ring so as to deform the skirt outward into the groove and thereby secure both the end face member and the ring in the knob. The end face member may have an opening for a core mounted in the knob sleeve, or for other usual knob accessories, or may completely close the end of the knob.

19 Claims, 10 Drawing Figures

DOOR KNOB CONSTRUCTION

CROSS REFERENCE

This is a continuation-in-part of our prior copending application Ser. No. 523,570 filed Nov. 14, 1974, now U.S. Pat. No. 3,955,387.

BACKGROUND OF THE INVENTION

This invention relates to a door knob of improved construction and attractiveness, especially adapted for use in the heavy duty cylindrical lock set shown in our co-pending application. That lock set employs a large-diameter spindle or knob sleeve shaped at its outer end to receive a key-removable core having a cylindrical portion containing a key plug mounted coaxially with the knob sleeve and having a radially projecting tumbler housing preferably of cylindrical shape so that the core as a whole is of FIG. 8 cross section. Such core is inserted and removed through the end face of the knob. The present invention provides a knob construction which may be used not only with such a key-removable core, but also to serve various other functions, and which is of especially sturdy construction and of solid and attractive appearance and "feel" but not excessively heavy.

In accordance with the invention, a knob body is formed with a large end opening or bore, preferably of circular section, whch provides tool access for internally machining other parts of the knob and which is adapted to receive an end face member large enough to contain the forward end of a key-removable lock core and its laterally projecting tumbler section.

The end face member is formed with a peripheral skirt and this is thrust axially against a stop in the end opening so as to deflect and deform the skirt outward into a groove formed in the wall of the opening, to permanently secure the end face member in the knob.

Perferably, the wall of the end opening is formed with an axially-outward facing shoulder and an adjacent radially-inward opening groove. A locating ring is positioned against the shoulder with its peripheral edge opposite and partially closing the mouth of the groove, and the skirt of the end face member is pressed axially against the edge of the ring so as to be deflected outward by such edge into entrapment in the groove. This secures both the end face member and the locating ring axially in place. At least one and desirably both of the skirt and ring may have bevelled edge surfaces to deflect the skirt outward.

Various end face members may be used in the same knob body to suit different functions. For example, one end face member may define a FIG. 8 opening to pass a FIG. 8 core and encompass its outer end; another may contain a central opening to receive a push button or turn button such as are used on inside knobs; and another may form a complete closure for the knob opening and may carry special decorations or emblems to suit a particular installation. The same knob body may also be used with a lock core which itself includes an end face member to close the knob opening and that is held in place by the core.

BRIEF DESCRIPTION OF THE DRAWINGS

The accompanying drawings illustrate the invention, and show the best mode presently contemplated for carrying out the invention. In such drawings.

DETAILED DESCRIPTION OF THE PREFERRED EMBODIMENTS

Figure 1:
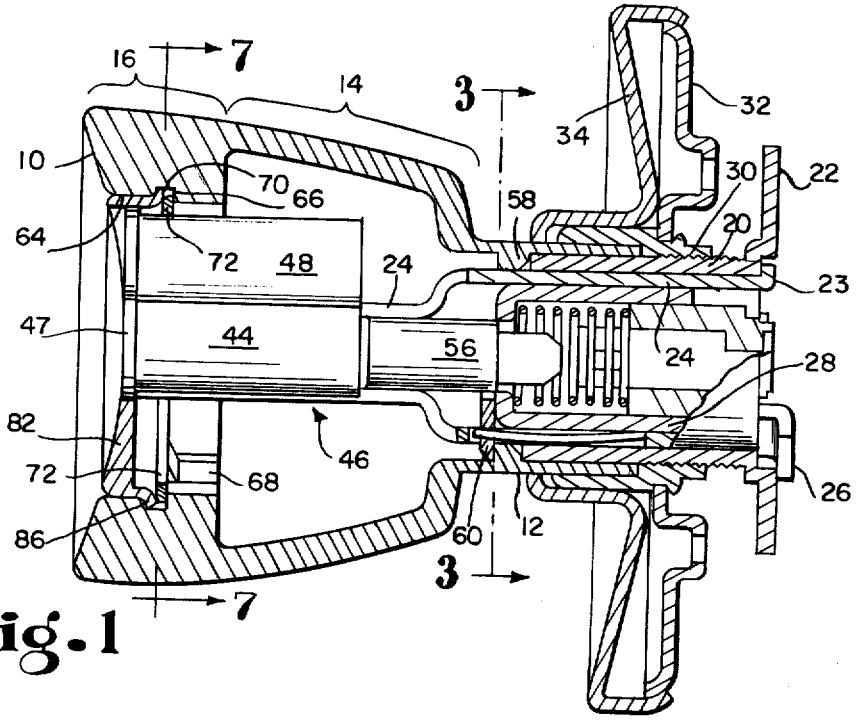
FIG. 1 is a vertical axial section of an outside door knob, in association with a portion of the cylindrical lock set on which the knob is mounted and with which it is operatively connected.

The lock mechanism shown in FIG. 1 comprises a knob 10 having a neck portion 12, an intermediate portion 14 of reduced wall thickness, and an outer end portion 16 of solid section. The knob is rotatably mounted by its neck portion 12 on a fixed hub 20 supported by the side plate 22 of a lock chassis as more fully explained in our co-pending application. A tubular spindle or knob sleeve 24 is rotatably mounted within the hub 20 and carries at its inner end a roll-back cam 26 for actuating the retractor of the lock set. The sleeve is held against outward movement by engagement of both the cam 26 and a lug 23 with end faces of the hub 20. The knob sleeve 24 entends outward to within the outer end portion 16 of the knob and is connected thereto as will be described below.

A key-actuated roll-back sleeve 28 is rotatably mounted within the inner end of the knob sleeve 24 and carries a second roll-back (not shown) for key actuation independently of the roll-back cam 26 of the knob sleeve.

The outer portion of the hub 20, to the extent that it lies within the neck 12 of the knob, is formed with a bearing surface for that neck. Inward of that bearing portion, the hub 20 is externally threaded and carries an axially adjustable escutcheon sleeve 30 to which is fixed a clamp plate 32 and an escutcheon trim facing 34.

Figure 7:
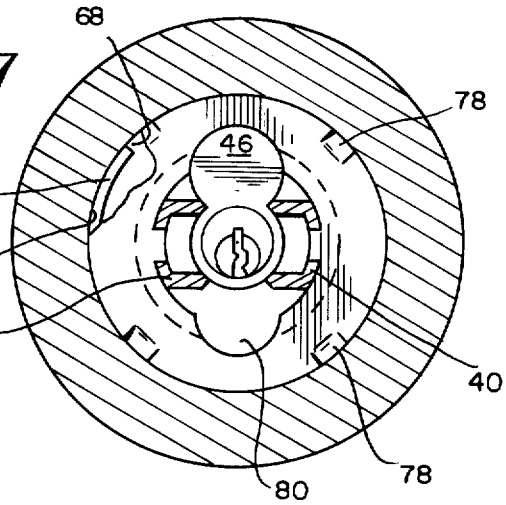
FIG. 7 is a section on the line 7—7 of FIG. 1.
Figure 8:
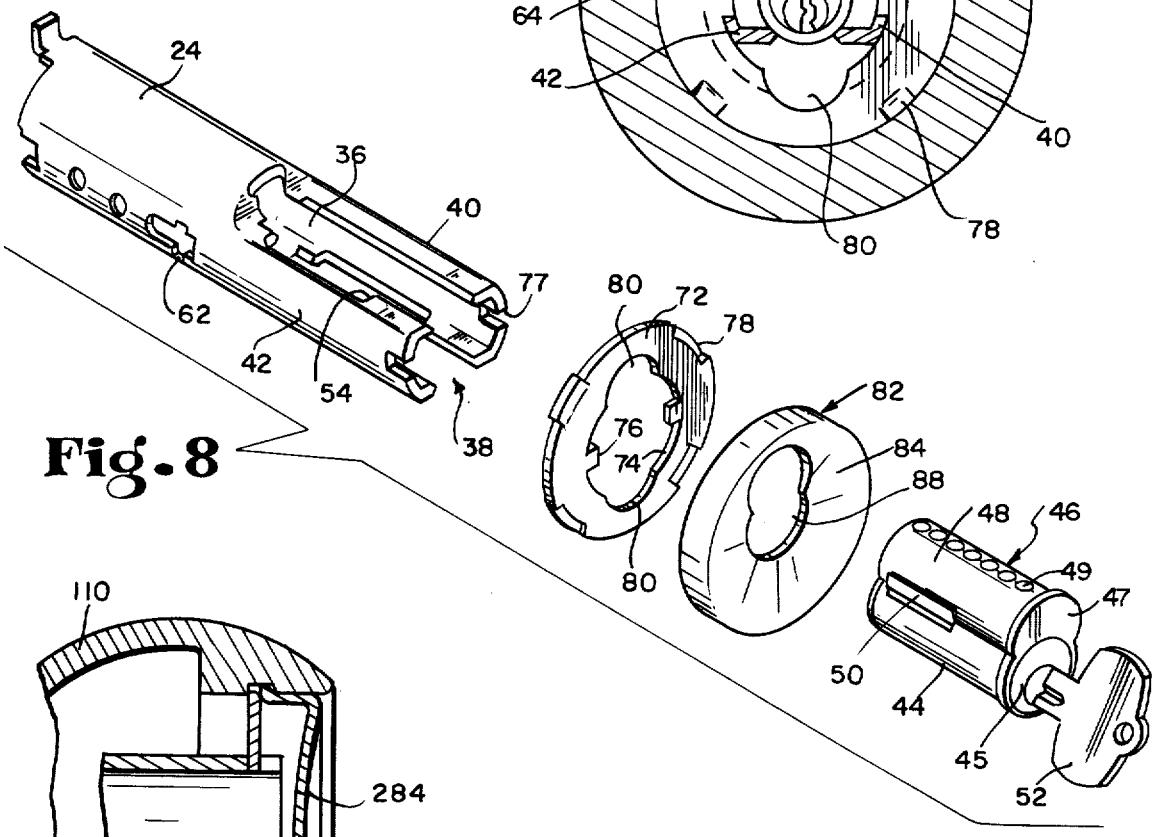
FIG. 8 is an isometric exploded view showing the knob sleeve of the outside knob and its relationship with a locating ring, an end face member, and a key-removable core.

As shown in FIGS. 1, 7, and 8, the knob sleeve 24 is a cylindrical tube which may be formed from flat stock stamped and rolled to shape. Its outer end is formed with two diametrically opposite slots 36 and 38, and the remaining wall portions are shaped to form two diametrically-opposed channel sections 40 and 42. The side legs of the two channel sections extend inward in two chordal planes, and their inner edges are dressed to fit and embrace the lower lobe 44 of a key-removable core 46 so as to form a mounting cage for the core. The core is desirably of FIG. 8 cross section, having a lower lobe 44 containing a key plug 45 and having an upper lobe 48 containing a row of pin tumblers mounted in bores 49. The core 46 has a narrow front face flange 47 which is used to locate the core axially in its mounting, and is retained in position by a lug 50 which normally projects through the side of the core and is retractable by use of a special control key 52. To provide for engagement of the lug 50 with the knob sleeve 24, the upper left and lower right edges of the pair of channel sections 40 and 42 are notched to form shoulders 54 behind which the lug of the core can be engaged to prevent retraction of the core from the knob sleeve. As here shown, it is contemplated that the core will be inserted in the knob sleeve with its face flange 47 tight against the end face of the channel sections 40 and 42. The two channel sections are symmetrical about the central axis of the knob sleeve so that they are adapted to receive the core 46 in either of two orientations, that is, with the knob sleeve in the orientation shown in FIG. 8 or rotated 180° therefrom for use in a door of opposite hand. As shown in FIG. 1, the key plug 45 of the core 46 is connected to the key-acutated roll-back cam 28 by a throw member 56.

As previously mentioned and as shown in FIG. 1, the neck 12 of the knob is rotatably mounted on the outer bearing portion of the hub 20. At the outer end of such hub, the neck 12 carries an internal flange 58 which bears against the end face of the hub 20 and which has an outer flat side face and an inner partially-bevelled side face. The knob is held against retraction from the hub 20 by a keeper 60 carried by the knob sleeve 24 and spring pressed outward through an opening 62 in the side wall of the knob sleeve into overlapping engagement with the outer face of the flange 58. The outer face of the keeper 60 is bevelled to ride over the bevelled inner face of the rib 58 as the knob is assembled on the sleeve 24. As shown, the keeper is inaccessible except by removing the core 46 and throw member 56 and inserting a tool through the passage thus provided for retracting the keeper 60 from engagement with the flange 58.

Figure 4:
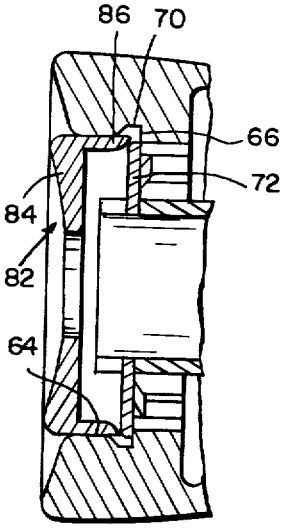
FIG. 4 is a fragmental sectional view similar to FIG. 1, showing the end face member in partially assembled relation with the knob.
Figure 3:
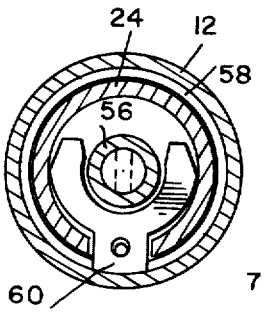
FIG. 3 is a section on the line 3—3 of FIG. 1.
Figure 5:
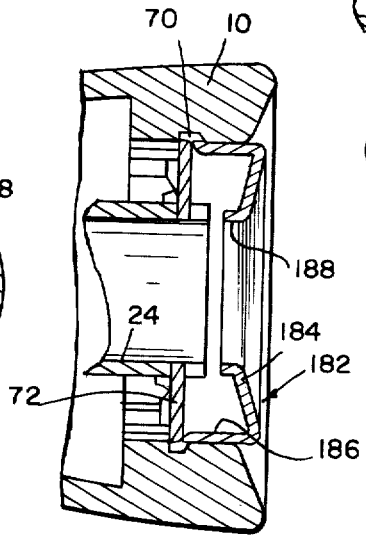
FIG. 5 is a sectional view similar to FIG. 2 but showing a modified end face member in partially assembled relation with the knob.
Figure 9:
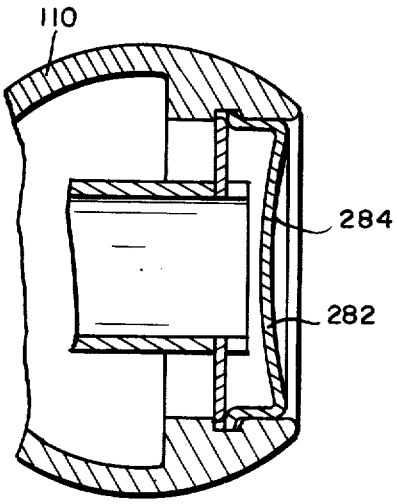
FIG. 9 is a fragmental sectional view showing a knob of spherical outside configuration and showing an alternative end face member.
Figure 10:
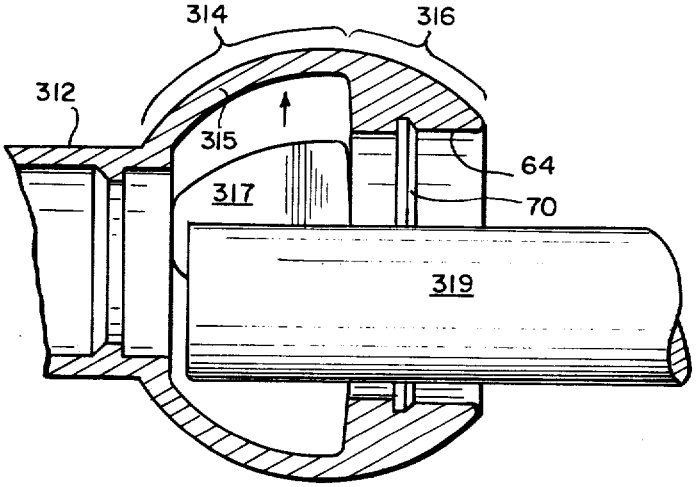
FIG. 10 is a machining diagram showing how the knob end opening provides tool access for internally machining other parts of the knob body.

The knob 10 is desirably machined from solid stock, and may have any desired external shape, such as the so-called tulip shape shown in FIGS. 1-5 or the spherical shape shown in FIGS. 9 and 10. In any case, the knob has an outer end portion 16 of thick and solid section. This contains a large central bore or opening 64, of a radius larger than the distance from the center of the key plug 45 of the core 46 to the top of the pin tumbler lobe 48 of that core. The bore 64 is formed with an axially-outward facing shoulder 66 intermediate its length, and inward of such shoulder has a smaller diameter portion which is broached with four axial slots 68. A radially-inward opening groove 70 is formed immediately in front of the shoulder 66. Such groove 70 desirably has a cross sectional shape as shown in FIGS. 4, 5, and 10. Its inner said face is desirably flat and coplanar with the shoulder 66, its bottom is conveniently cylindrical, and its outer side face is desirably conical. Its total width at its mount is greater than the thickness of the locating ring mentioned below, by an amount at least equal to the thickness of the peripheral wall of the end face member also mentioned below.

The outer end of the knob 10 is supported from the outer end of the knob sleeve 24 by a locating ring 72. As shown in FIG. 8, this has a central opening 74 adapted to fit over the outer circumferential surfaces of the knob sleeve 24 and has a pair of diametrically opposite tongues 76 which engage in slots 77 in the end of the knob sleeve 24. The locating ring 72 also has four tabs 78 offset from the plane of the ring, which engage in the broached slots 68 when the ring is positioned in the knob, to center the ring in the knob and to fix it against rotation and axially in the knob. The central opening 74 of the locating ring 72 also has upper and lower extensions 80 to provide clearance for the pin tumbler lobe 48 of the core 46 in either of its two orientations with respect to the knob sleeve 24. The peripheral edge of the ring 72 is desirably formed with a rounded or otherwise bevelled corner 71 at the axially-outward face of the ring (FIG. 6), for purposes described below. The ring is conveniently a stamped sheet metal part with a sheared edge, and shearing normally produces a slightly rounded corner at one face of the piece. The rounding so produced may be used for present purposes if the opposing skirt is suitably shaped.

The outer end of the bore 64 of the knob 10 is closed by a face plate 82. The face plate 82 shown in FIGS. 1 and 4 is machined from solid stock and originally has the shape shown in FIG. 4. This includes an outer wall 84 and an axially projecting peripheral skirt 86. Such skirt desirably has a rounded or otherwise bevelled inner edge, so as to be deflected outward when pressed against the rounded edge of the ring 72. The wall 84 has an opening 88 of FIG. 8 shape to mate with the shape of face flange 47 of the core 46, and such opening is located with its inner lobe centered in the end face member 82 so that it will lie coaxial with the knob sleeve 24 in the relationship indicated in FIG. 8. The opening 88 of the end face member 82 is desirably sized to receive the face flange 47 of the core 46 and allow the core to be seated in the forward end of the knob sleeve 24 with such flange 47 lying tight against the end faces of the channels 40 and 42 of that knob sleeve.

An an alternative, the opening in the face member ,may be of a size to fit the main body of the core 46, and may have a front peripheral groove to seat the flange 47 of the core, or the core 46 may be fixed to the end face member. In either such case, the core, when locked in place, will also retain the end face member in position in the knob. Such an alternative construction is shown in our co-pending application and the knob body here shown may be used with it in specific situations, but the construction here shown is preferred.

When the knob is assembled in accordance with the present invention, the end face member 82 is permanently secured in the end opening 64. In assembly, the end face member 82 is first inserted in the opening 64 to bring the end of its skirt 86 into engagement with the peripheral edge of the locating ring 72 seated against the shoulder 66 and lying coplanar with the inner portion of the undercut groove 70, as shown in FIG. 4. In this position the corner of the bevelled end of the skirt 86 engages the rounded corner 71 of the ring 72, so that axial thrust on the skirt will tend to deflect the skirt outward. The circumferential edge of the ring lies opposite the groove and partially closes the mouth of the groove but leaves an opening into which the skirt may move as it is deflected outward. The end face member 82 is pressed inward from this position, and this causes the bevelled edge of the skirt to be deflected and deformed outward into entrapment in the groove 70, as shown in FIG. 1. This secures the end face member 82 and the ring 72 in place in the knob. The position to which the end face member 82 is pressed may be varied as desired, but preferably brings the end face member 82 into seated position in the end opening 64 so that its outer face is flush with the outer end face of the knob 10.

Figure 6:
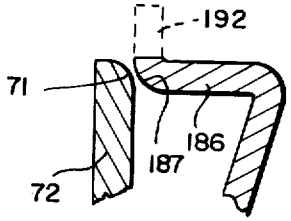
FIG. 6 is an enlarged fragmental view showing a preferred shape and relationship of a knob locating ring and the skirt of the end face member of FIG. 5.
Figure 2:
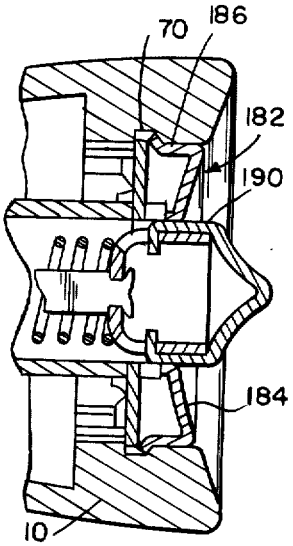
FIG. 2 is a similar but fragmental section of a corresponding inside knob containing a turn button, and showing a modified end face member.

In the modification shown in FIGS. 2 and 5, the end face member 182 is formed of sheet metal. It has an end wall 184 formed with a central circular opening 188 adapted to receive a push button or turn button 190. The end face member 182 also has a skirt 186, which is desirably formed as shown in FIG. 6. When the sheet metal end face member 182 is originally formed, it is integral with a flange 192 shown in dotted lines in FIG. 6, and the skirt 186 is formed by forcing metal out of the plane of the flange 192. This produces a bend at the junction between the flange 192 and 186, which forms a rounded inner corner 187 on the skirt 186. The flange 192 is subsequently sheared off substantially at the outer surface of the skirt 186, to leave the rounded-off end on that skirt. Similarly, as shown in FIG. 6, the locating ring 70 is trimmed at its periphery by a shearing operation which leaves the rounded-off corner 71 at its face which is presented to the rounded-off end of the skirt 186. Such rounded corners provide the desired bevelled surfaces so that when the end face member 182 is pressed into place and moved from the position shown in FIG. 5 to that shown in FIG. 2, the skirt is deformed and deflected outward into the groove 70 and entrapped therein to lock the end face member 182 permanently in place in the end of the knob 10.

The alternative shown in FIG. 9 is similar to that of FIG. 2, except that the knob 110 is of spherical shape to illustrate that other shapes may be used beside the tulip shape of FIG. 2, and except that the outer end wall 284 of the end face member 282 is plain and imperforate so as to completely close the outer end of the knob without leaving any opening. Such end wall may be formed with any desired emblem or design.

The large end opening in the knob not only permits the knob to receive an end face member 82 or 282 of a size sufficient to contain a key-removable core 46 as shown in FIG. 1, but it also permits the knob to be machined from solid stock with a deeply undercut and recessed mid-portion. Such machining is shown somewhat diagrammatically in FIG. 10. The knob shown is of spherical shape, but has an outer portion 316 of solid section containing an end opening 64 identical with that in the knobs of FIGS. 1 and 2. It has an intermediate portion 314 of reduced wall thickness, and a neck portion 312 identical with the neck 12 of the knob 10 in FIG. 1. The reduced-thickness wall 315 of the intermediate portion 314 is formed by suitably machining the external surface and by undercutting the inside of the workpiece. The undercutting is deep, and may be done in two or more steps. Access for such deep undercutting is provided by the large end opening 64. The undercutting tool shown in FIG. 10 may be considered a finishing tool and consists of a shaped cutter tooth 317 mounted on a sturdy bar 319. The tooth 317 must project a substantial distance from the bar 319 in order to advance the full depth necessary, and the supporting bar 319 must be large and sturdy to support the deep-cutting tooth. The size of the hole 64 permits the use of the necessary tool and permits its insertion and removal to and from the work. Similarly, the entire inner configuration of the knob may be formed by tools inserted in successive machining steps through the end opening 64, and this permits knobs to be machined from bar stock in a single set-up.

The resulting machined knob, whether of tulip shape as in FIG. 1, spherical shape as in FIGS. 9 and 10, or of other shape, has the strength and rigidity of a knob formed from solid stock. Its entire grasping surface, i.e., that which normally comes in contact with a hand gripping and operating the knob, is the surface of the one-piece machined body with no joints or overlapping walls to interrupt the smooth and solid "feel" of the knob. The knob includes an outer solid portion 16 or 316 by which the knob is supported from the sturdy knob sleeve when mounted in place and which has the necessary mass and rigidity to give a solid feel to the entire knob. The wall of the intermediate portion 14 or 314 is of substantial thickness so as to contribute to the solid feel of the knob, yet the deep undercut and reduced thickness of such wall reduces the weight of the knob as a whole and recovers excess material.

The large outer opening is closed by an end face member 82, 182, or 282 which is securely and permanently fixed in place in the solid outer end portion to provide an end wall and surface which pleasingly conforms with the shape and appearance of the knob. The knob body may be used in various applications and may be fitted with any of various end face members to suit different applications.

I claim:

1. A knob construction, comprising a knob body having an outer end opening of circular cross section, the wall of said opening being formed with an axially-outward-facing stop shoulder and a radially-inward-opening groove forward of such shoulder, and an end face member having a peripheral skirt extending toward said stop shoulder, said skirt being pressed toward said shoulder so as to deform the same outward into said groove to secure the member in place in the end opening of the body.

2. A knob construction as in claim 1 with the addition of a ring positioned against said stop shoulder with its circumferential edge opposite a portion of said groove, the end of said skirt being pressed against said ring and deflected outward thereby into the groove to secure the end face member in the knob opening.

3. A knob construction as in claim 2 in which the peripheral edge of said ring is at least partially bevelled to deflect the skirt outward.

4. A knob construction as in claim 2 in which the skirt has a bevelled ring-engaging surface which causes the skirt to be deflected outward when pressed against said ring.

5. A knob construction as in claim 3 in which the skirt has a bevelled ring-engaging surface which causes the skirt to be deflected outward when pressed against said ring.

6. A knob construction, comprising a knob body having an outer end opening, a radially-inward-facing groove in the wall defining such end opening, stop means positioned in said opening, and an end face member having a skirt pressed against said stop means and thereby deformed outward into said groove to secure the member in the end opening.

7. A knob construction, comprising a knob having a neck portion, an intermediate portion, and an outer end portion, the intermediate and end portions forming a handle by which the knob may be grasped for operation, said outer end portion being formed with an end opening sufficient to clear a key-actuated lock core having a cylindrical body containing a key-rotatable plug mounted coaxially of the knob and having a pin-tumbler section extending laterally from the cylindrical body, the wall of said end opening being formed with an axially-outward-facing shoulder and a radially-inward-opening groove, a locating ring mounted in said opening with its edge opposite a portion of the mouth of said groove, and an end face member fitted in said end opening and having a peripheral skirt, the end of such skirt being pressed against the edge portion of the ring and thereby deformed outward into the groove to secure the member in the knob, said end member being of a size to contain the end of a lock core as defined.

8. A knob construction as in claim 7 in which the intermediate portion of the knob is internally machined to an inside dimension substantially larger than said end opening so that its wall thickness is substantially less than that of the end portion.

9. In combination, a knob as defined in claim 7, a knob sleeve over which the neck of the knob is mounted and which extends through the plane of said locating ring and substantially to said end face member, said end face member containing an opening to pass a lock core, and a lock core mounted in the end of the knob sleeve, independently of, but with its outer end lying within, the end face member.

10. A cylinder lock, comprising a lock chassis having a projecting knob sleeve formed at its end to provide a cage for mounting a key-removable core therein, a knob mounted about said sleeve, said knob having a neck portion mounted for rotation coaxially with the knob sleeve and having an outer end portion formed with an end opening larger than the knob sleeve, the wall of said end opening being formed with an axially-outward-facing shoulder and an adjacent radially-inward-opening groove, a locating ring seated on said shoulder and engaging said knob sleeve to locate the outer end of the knob coaxially with the knob sleeve, the circumferential edge of said ring being disposed opposite said groove to partially close the mouth thereof, and an end member fitted in said end opening and having a skirt portion pressed against the edge of said ring and deformed outward thereby into entrapment in the groove to secure itself and the ring axially in place in the knob.

11. A cylinder lock as in claim 10 in which said member contains an opening to pass a key-removable core to the mounting cage in said knob sleeve and to closely surround the outer end of such core when the same is mounted therein.

12. A cylinder lock as in claim 10 in which the core mounting cage includes an end face on the knob sleeve which is engaged by a face flange on the core to locate the core axially in the sleeve, and said knob end face member contains a through opening to pass such front flange to such engaged position, and with the addition of means to fix the position of the knob axially of the sleeve independently of the end face member, so as to dispose the end face member in the plane of the face flange of a core mounted in said cage.

13. A cylinder lock, comprising a lock chassis having a projecting knob sleeve formed at its outer end to provide a cage for mounting a key-removable core therein, said cage being open at its outer end for insertion of the core endwise therein and having an end face for engagement by a face flange on the core to locate the core axially in the cage, a knob mounted about said sleeve, said knob having a neck portion mounted for rotation coaxially with the knob sleeve and having an outer end portion formed with an end opening larger than the knob sleeve, a locating ring fixed in the outer end portion of the knob and engaging said knob sleeve inward of its said end face to locate the outer end of the knob coaxially with the knob sleeve, and an end face member fitted in said end opening and having an opening therein to pass the face flange of the core through the member for engagement with said end face on the knob sleeve, the knob and core being thereby supported by the knob sleeve independently of each other.

14. A cylinder lock, comprising a lock chassis having a projecting knob sleeve formed at its end to provide a cage for mounting a key-removable core therein, said cage being open at its outer end for insertion of the core endwise therein and having an end face for engagement by a face flange on the core to locate the core axially in the cage, a knob mounted about said sleeve, said knob having a neck portion mounted for rotation coaxially with the knob sleeve and having an outer end portion formed with an end opening larger than the knob sleeve, means in said end opening for forming an end face on the knob and for engaging the knob sleeve rearward of the end face of such sleeve to locate the outer end of the knob coaxial with the knob sleeve, said means having an opening therein to expose said end face for engagement by a core face flange and to pass a core into the cage and pass its face flange into engagement with said end face, the knob and core being thereby supported by the knob sleeve independently of each other.

15. The method of closing the outer end of a knob having an end opening therein, comprising the steps of forming the end opening with an axially-outward-facing stop shoulder and an adjacent radially-inward-opening groove, forming an end face member to fit in said end opening outward of said shoulder and having a skirt extending toward said shoulder, and pressing said member toward the shoulder so as to compressively deform said skirt and force the end thereof outward into said groove.

16. The method of claim 15 with the addition of placing a ring on said shoulder to define an outward-facing edge at the inward-facing mouth of said groove, and pressing said skirt against said ring to deform the edge thereof outward into said groove.

17. The method of claim 16 with the addition of forming a bevelled surface on at least one of the ring and skirt to deflect the skirt outward as it is pressed against the edge of the ring.

18. A knob construction as in claim 2 in which the groove has a sloping outer side face presented toward the outwardly-deflected edge of the skirt.

19. A knob construction as in claim 5 in which the groove has a sloping outer side face presented toward the outwardly-deflected edge of the skirt.

* * * * *